US007244004B2

(12) United States Patent
Hightower

(10) Patent No.: US 7,244,004 B2
(45) Date of Patent: Jul. 17, 2007

(54) CORNER PROTECTOR

(75) Inventor: Robert C. Hightower, High Point, NC (US)

(73) Assignee: Tenn-Tax Plastics, Inc., Colfax, NC (US)

( * ) Notice: Subject to any disclaimer, the term of this patent is extended or adjusted under 35 U.S.C. 154(b) by 395 days.

(21) Appl. No.: 10/602,899

(22) Filed: Jun. 24, 2003

(65) Prior Publication Data

US 2004/0262194 A1 Dec. 30, 2004

(51) Int. Cl.
*A47F 9/00* (2006.01)

(52) U.S. Cl. ..... 312/137; 428/99; 206/586

(58) Field of Classification Search ..... 312/137; 108/27; 206/586, 521; 428/119–120, 99; 49/460; 16/18 CG
See application file for complete search history.

(56) References Cited

U.S. PATENT DOCUMENTS

| | | | | |
|---|---|---|---|---|
| 4,619,365 | A * | 10/1986 | Kelly et al. | 206/503 |
| 4,883,179 | A * | 11/1989 | Dionne | 206/586 |
| 4,951,821 | A * | 8/1990 | Kempkes | 206/586 |
| 5,033,669 | A | 7/1991 | Federico | |
| 5,037,027 | A | 8/1991 | Nichols | |
| 5,392,920 | A * | 2/1995 | Prete | 206/586 |
| 5,431,336 | A * | 7/1995 | Clee | 229/199 |
| 5,560,172 | A * | 10/1996 | Brophy et al. | 52/596 |
| 5,678,692 | A * | 10/1997 | Gratz | 206/453 |
| 5,947,037 | A * | 9/1999 | Hornberger et al. | 108/27 |
| 6,039,184 | A * | 3/2000 | Gale | 206/586 |
| 6,103,335 | A * | 8/2000 | Zoller et al. | 108/27 |
| 6,305,599 | B2 * | 10/2001 | Tsubaki et al. | 229/122.23 |
| 6,368,694 | B1 | 4/2002 | Marsh et al. | |
| 6,478,354 | B1 * | 11/2002 | Eyal | 206/453 |
| 6,516,730 | B1 * | 2/2003 | Mason | 108/55.1 |
| 6,571,529 | B2 * | 6/2003 | Knudson et al. | 52/745.05 |
| 6,782,673 | B2 * | 8/2004 | Azar | 52/604 |
| 6,881,469 | B2 * | 4/2005 | Hightower | 206/586 |
| 2001/0001445 | A1 * | 5/2001 | Gallien | 206/453 |

FOREIGN PATENT DOCUMENTS

| | | |
|---|---|---|
| EP | 570614 | * 11/1993 |
| EP | 1357056 | * 10/2003 |

OTHER PUBLICATIONS

Hightower, Edge and Corner Protector, U.S. Appl. No. 10/413,760; Filed Apr. 15, 2003.

* cited by examiner

*Primary Examiner*—Lanna Mai
*Assistant Examiner*—Hanh V. Tran
(74) *Attorney, Agent, or Firm*—Myers Bigel Sibley & Sajovec

(57) ABSTRACT

A protective device that may be used to shield the corner of an object from damage during shipping, storage, handling or the like comprises a top member, an outer wall, an inner wall opposite the outer wall and a side wall. The walls are connected (either directly or indirectly) to the top member and extend downwardly therefrom, and the side wall and outer wall meet to form an acute angle (e.g., a 45 degree or a 67.5 degree angle). The protective device may also include a raised lip that extends upwardly from the top member along at least a portion of the periphery of the top member and may include ribs that are disposed on the top surface of the top member.

23 Claims, 4 Drawing Sheets

CORNER PROTECTOR

FIELD OF THE INVENTION

The present invention relates to protective devices useful for shielding the corners of cabinetry, furniture and other objects during shipping, storage and handling.

BACKGROUND OF THE INVENTION

Wood cabinetry (such as cabinetry for home and kitchen installation) and numerous other objects are often manufactured in plants and then shipped to the location in which they are installed. Often the cabinetry or object at issue is shipped to a central storage location or vendor prior to delivery to the customer, or end user, for installation. The cabinetry or other object can be damaged at any point in the distribution process. Such damage may also occur during the shipment of items, such as, for example, furniture that is fully manufactured and then shipped to another location, such as to a purchaser or a retail sales outlet. In either case, if damage occurs, it is typically necessary to replace the object or deliver a substitute part and repair the object on site. Either choice can be expensive and time consuming. Accordingly, the corners of cabinets and various other objects—which may be particularly susceptible to damage—are often shielded by some sort of protector. Such corner protectors are removed and discarded when the object is delivered for installation. One known type of corner protector—which may be used only on 90 degree angle corners—is disclosed in U.S. Pat. No. 6,368,694. Another corner protector useful for 135 degree angle corners is disclosed in U.S. patent application Ser. No. 10/413,760, now U.S. Pat. No. 6,881,469 filed by Robert Hightower on Apr. 15, 2003. Otherwise, current corner protectors typically are rudimentary in nature, such as corrugated paper, foam molded blocks or plastic corner protectors that are fastened in place with staples or the like, or held in place by the outer packaging (corrugated cardboard, shrink-wrap packaging, etc.) of the object that is to be protected.

SUMMARY OF THE INVENTION

The present invention relates to protective devices that may be used to shield the corners of cabinetry, furniture and/or other objects from damage during shipping, storage, handling or the like. Pursuant to one embodiment of the present invention, the protective device comprises a top member, an outer wall, an inner wall opposite the outer wall and a side wall. The walls are connected (either directly or indirectly) to the top member and extend downwardly therefrom, and the side wall and outer wall meet to form an acute angle. In specific embodiments of the present invention, the acute angle may be approximately a 45 degree angle or a 67.5 degree angle, although various other acute angles may also be used.

The protective device may further include a raised lip that extends upwardly from the top member along a portion or the entirety of the periphery of the top member. The device may also include one or more reinforcing ribs that are disposed on the top surface of the top member. At least some of these reinforcing ribs may extend across the width of the top member so as to extend from the inner wall to the outer wall.

The inner wall and the outer wall may vary in length. Additionally, a recess may be provided in the inner wall adjacent the side wall. The inner wall and outer wall may also define a channel that resides below a lower surface of the top member. The width of this channel may be slightly less than the width of the wall that forms part of the corner of the object that is to be protected. The inner and outer walls may be at least slightly resilient such that the channel forms an interference fit with the wall when the wall is received within the channel. The protective device may be integrally formed of polymeric material, such as by injection molding thermoplastic material.

Pursuant to another embodiment of the present invention, the protective device is a corner protector that comprises (a) an outer wall for protecting the outside edge of the object, (b) an inner wall located opposite the outer wall and running substantially parallel to the outer wall, (c) a side wall that connects with the outer wall to form an acute angle (e.g., 45 degrees or 67.5 degrees) and that connects with the inner wall to form an obtuse angle (e.g., 135 degrees or 112.5 degrees) and (d) a top member disposed between and connected to at least one of the walls. In this embodiment, typically the top member is substantially perpendicular to the wall members. The wall members may extend above the top surface of the top member so as to form a ridge around at least part of the periphery of the top member. One or more support ribs may also be provided on the top surface of the top member to provide additional support to the top portions of one or more of the wall members. The inner and outer walls may be at least slightly resilient and may define a channel that runs below a lower surface of the top member. Moreover, the width of this channel may be slightly less than the width of the wall of the object over which the corner protector is to be placed such that the channel forms an interference fit with the wall of the object.

The present invention is explained in greater detail in the detailed description and drawings set forth below.

DETAILED DESCRIPTION OF THE INVENTION

The present invention will now be described more fully hereinafter with reference to the accompanying drawings, in which illustrative embodiments of the invention are shown. This invention may, however, be embodied in many different forms and should not be construed as limited to the illustrated embodiments or other embodiments set forth herein; rather, these embodiments are provided so that this disclosure will be thorough and complete, and will fully convey the scope of the invention to those skilled in the art. In the figures, the dimensions of some components may be exaggerated for clarity.

Figure 1:
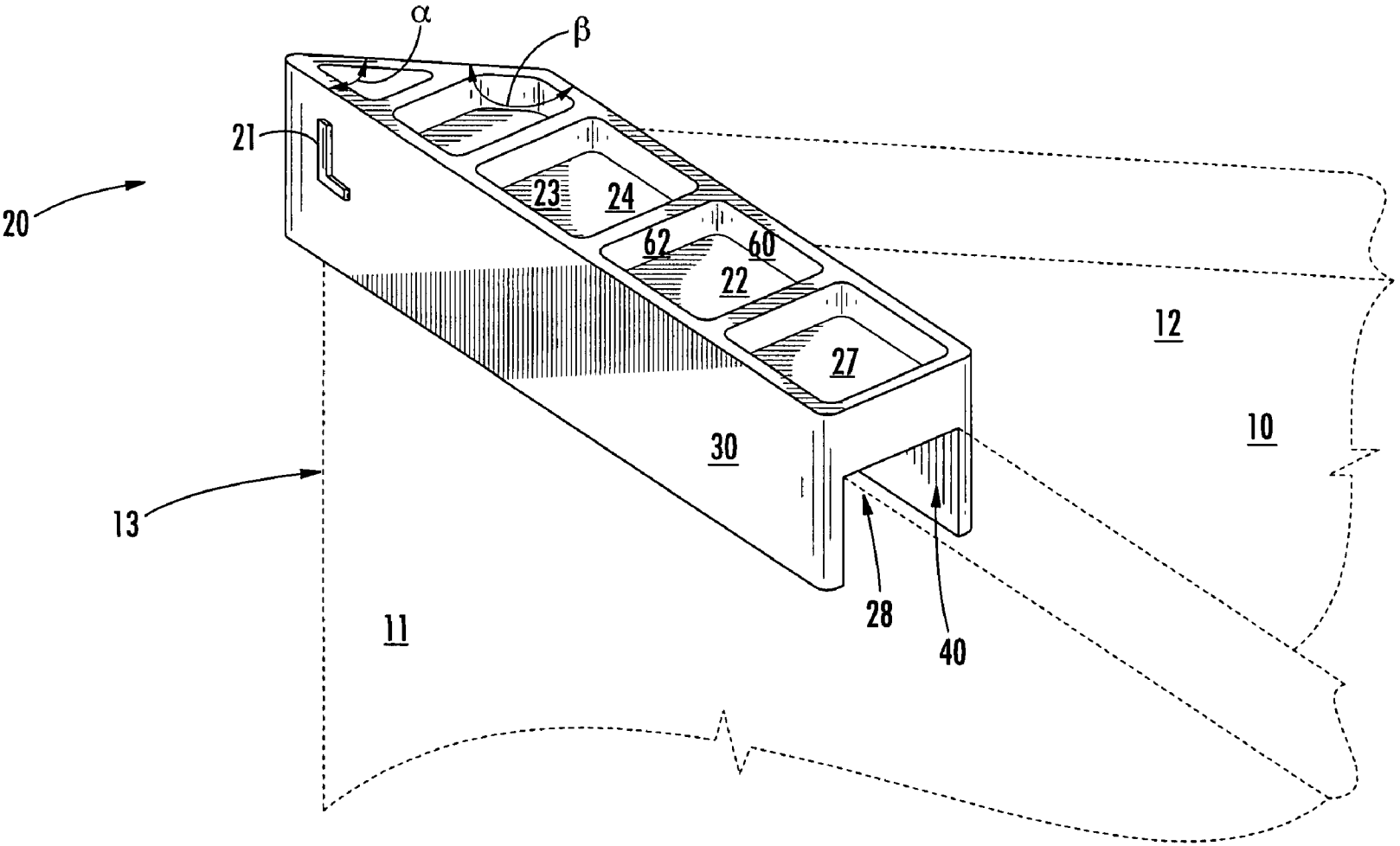
FIG. 1 is a perspective view of a protective device according to embodiments of the present invention installed on a cabinet.
Figure 2:
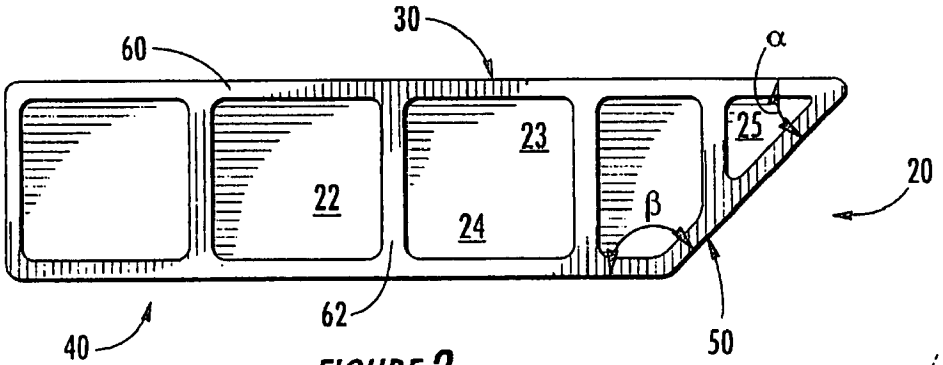
FIG. 2 is a top view of the protective device of FIG. 1 in an uninstalled state.
Figure 3:
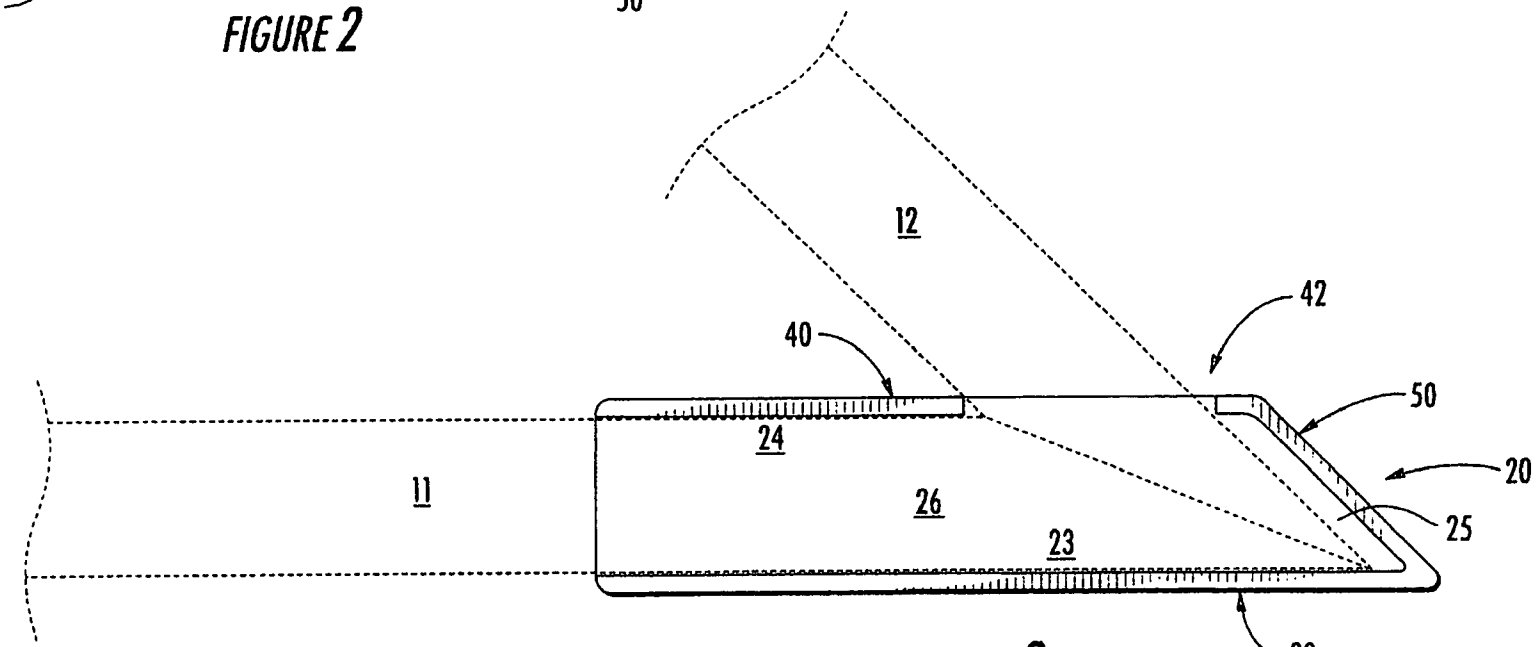
FIG. 3 is a bottom view of the protective device of FIG. 1 in an uninstalled state.

FIGS. 1-3 depict a protective device 20 that may be used on a cabinet or other object 10. In FIGS. 1-3, the cabinet 10 has walls 11, 12 that meet to form a 45 degree angle corner 13. As illustrated, the corner protector 20 comprises a top member 22 having an outer portion 23, an inner portion 24, a side portion 25 and a generally flat planar bottom portion 26. An outer wall 30 is connected to, and projects downward from, the top member outer portion 23. An inner wall 40 is connected to, and projects downward from, the top member 22 inner portion 24. The inner wall 40 is positioned generally opposite (and typically parallel to) the outer wall 30. A side wall 50 is connected to, and projects downward from, the top member 22 side portion 25. Note that as used herein, the term "connected to" is intended to encompass objects that are directly connected to each other and objects that are connected to each other through one or more additional structures.

In the embodiment of FIGS. 1-3 of the present invention, the outer wall 30 and the side wall 50 define an acute angle $\alpha$ which in the pictured embodiment is approximately 45 degrees. The side wall 50 and the inner wall 40 define an obtuse angle $\beta$ which in the pictured embodiment is approximately 135 degrees. It will be appreciated that the angles $\alpha$, $\beta$ may be angles other than the angles depicted in FIGS. 1-3. Preferably, the angles $\alpha$, $\beta$ are selected so that the protective device will fit snugly over the corner 13 of the object 10 that is to be protected.

The protective device 20 may include a raised lip 60 that extends upwardly from the top member 22. This raised lip 60 may extend around the entire of the periphery of the top member 22 as illustrated in the embodiment of FIGS. 1-3, or may alternatively extend around just a portion of the periphery or may be omitted altogether. As shown in FIGS. 1-3, the raised lip 60 may effectively extend the outer wall 30, the inner wall 40 and/or the side wall 50 so that one or more of those walls extend above the top surface 27 of the top member 22. The provision of such a raised lip 60 may be particularly helpful when the protective device is used to protect the bottom of an object 10 because it spaces the object 10 from the floor, or where it is used to protect a top portion of an object 10 that may have other items stacked on top thereof.

The raised lip 60 may also increase the structural integrity of the protective device 20. It may also enhance the protection that the protective device 20 provides. Specifically, when the protective device 20 is installed on a cabinet 10 and the cabinet is dropped or inadvertently banged against a door, wall or other foreign object, in many instances the raised lip portion 60 of the protective device 20 will be the part of the protective device that comes into direct contact with the floor or other foreign object. When this occurs, a greater amount of protective material is provided between the foreign object and the cabinet 10 that is to be protected, and this increased amount of protective material may absorb and cushion the amount of force that is applied to the cabinet 10. Additionally, when the foreign object contacts the protective device at the apex of angle $\alpha$ (which is one of the most likely places of contact), the raised lip 60 may facilitate distributing the force applied by such contact along at least part of the length of the raised lip, thereby reducing the amount of force applied on the corner 13 of the object 10. As the corner 13 is often one of the most easily damaged parts of the object 10, the provision of the raised lip 60 may, in some instances, significantly reduce the possibility of damage to the underlying object during shipping, storage, handling or the like.

The raised lip 60 may also include an outwardly projecting ridge member 61 (not shown in FIGS. 1-3) along all or part of those portions of the raised lip 60 that are provided above the outer wall 30 and/or the side wall 50. This ridge member 61 may further shield and protect the corner 13 from damage when the protective device is installed on the cabinet 10.

As shown in FIGS. 1 and 2, one or more reinforcing ribs 62 may be provided on the top surface 27 of top member 22 to reinforce the raised lip 60. These ribs 62 preferably are the same height as the raised lip 60. It will be appreciate that a wide variety of different configurations for the raised lip 60, the ridge member 61 and the reinforcing ribs 62 may be used, and that one or more of these features may be omitted altogether.

As shown best in FIG. 1, the outer wall 30, the inner wall 40 and the bottom surface 26 of the top member 22 form a channel 28 that resides below the lower surface 26 of the top member 22. The channel 28 is configured to receive the wall 11 of the object 10 that is to be protected. The width of the channel 28 (i.e., the distance between the inner surfaces of the outer wall 30 and the inner wall 40) may be made to be slightly less than the width of the wall 11. The outer wall 30 and the inner wall 40 may also be at least slightly resilient, flexing at or near the points where the walls connect to the top member 22. A force may be applied to one or both the outer wall 30 and the inner wall 40 so as to cause one or both walls 30, 40 to deflect outwardly (i.e., away from the interior of the channel 28). In so doing, the width of the channel 28 may increase sufficiently to greater than the width of the wall 11 of object 10 such that the top of the wall 11 may be received within the channel 28. When the force is released, the wall(s) 30, 40 to which the force was applied attempt to spring back into place, such that they walls 30, 40 engage the exterior and interior surfaces of wall 11. In this manner, the outer wall 30 and the inner wall 40 form an "interference fit" with the wall 11 in that the wall 11 is snugly, but removably, secured in between the walls 30, 40. This may eliminate the need to secure the protective device 20 in place with staples, tape, shrink wrap packaging or the like. The outer wall 30 and the inner wall 40 may also be angled so that the channel 28 narrows slightly adjacent the distal ends of the walls 30, 40 to facilitate providing an interference fit between the walls 30, 40 and the object 10 that is to be protected.

As illustrated best in FIG. 1, the protective device 20 may be installed to protect the corner 13 of an object 10 by placing the top member 22 over the corner 13 (which is formed by the junction of the walls 11, 12) that is to be protected, with the inner face of the outer wall 30 abutting the outer face of the wall 11, the inner face of the inner wall 40 abutting the inner face of the wall 11, and the inner face of the side wall 50 abutting the outer face of the wall 12. The side wall 50 and the outer wall 30 may form an angle $\alpha$ that is approximately equal to the angle associated with the corner 13 (i.e., the angle formed by the walls 11 and 12).

As shown best in FIG. 3, a recess 42 may be provided in the inner wall 40. This recess 42 may be configured to receive the wall 12 of the object 10 that is to be protected when the protective device 20 is placed on the object 10 (see FIG. 1). The recess 42 may extend from a point in middle of inner wall 40 all the way to the side wall 50, or alternatively the recess 42 may not extend all the way to the side wall 50. Typically, however, the recess 42 will generally be adjacent (although not necessarily directly adjacent) the side wall 50.

As shown best in FIGS. 2 and 3, the inner wall 40 and the outer wall 30 need not be of the same length. In fact, in many embodiments of the present invention it may be more convenient to have an outer wall 30 that is longer than the inner wall 40 since the side wall 50 connects to the outer wall 30 at an acute angle $\alpha$.

Typically, the cabinets or other objects 10 on which the protective devices 20 of the present invention are used will need protective devices for corners on at least two different sides. As will be appreciated by persons of skill in the art, the protective device 20 depicted in FIGS. 1-3 is configured to fit on the left side of such a cabinet 10. A corresponding protective device (having an outer wall, inner wall and side wall) would be provided to protect the corner on the right side of the object 10 (assuming that the object 10 is symmetrical). This corresponding protective device would be the mirror image of the protective device 20. The protective devices 20 may include indicia 21 such as the letter "R" or "L" to indicate which side of the object 10 they are to be used on.

As shown best in FIG. 1, the raised lip 60 may extend from the top portion of one or more of the outer wall 30, the inner wall 40 and/or the side wall 50. In this manner, the outer wall 30 and the raised lip 60 together form a continuous outer wall that extends both above and below the top member 22, the inner wall 40 and the raised lip 60 together form a continuous inner wall that extends both above and below the top member 22, and the side wall 50 and the raised lip 60 together form a continuous side wall that extends both above and below the top member 22.

The present invention can be embodied in a variety of different forms. For example, the outer, inner and side walls 30, 40, 50 may take on a variety of different shapes (e.g., rectangular, square, curved, etc.) and sizes. The outer wall 30 and the side wall 50 also need not meet to form an apex, although such a design is usually preferred as it may provide enhanced protection to the corner of the object 10. The top member 22 may also be implemented in a variety of different shapes and sizes, and may or may not include reinforcing ribs or ridges or the like. The top member 22 also need not connect with all three of the outer wall 30, the inner wall 40 and the side wall 50; for instance, the top member 22 might only connect to the outer wall 30. The walls may also include various reinforcing structures such as ribs or thickened sections and/or bumpers that provide additional protection (not shown in FIGS. 1-3). Additionally, while in FIGS. 1-3 the various walls and members are shown as being solid, it will be appreciated that the various walls and members need not be solid but could instead have a variety of openings, hollowed out areas etc.

Figure 4:
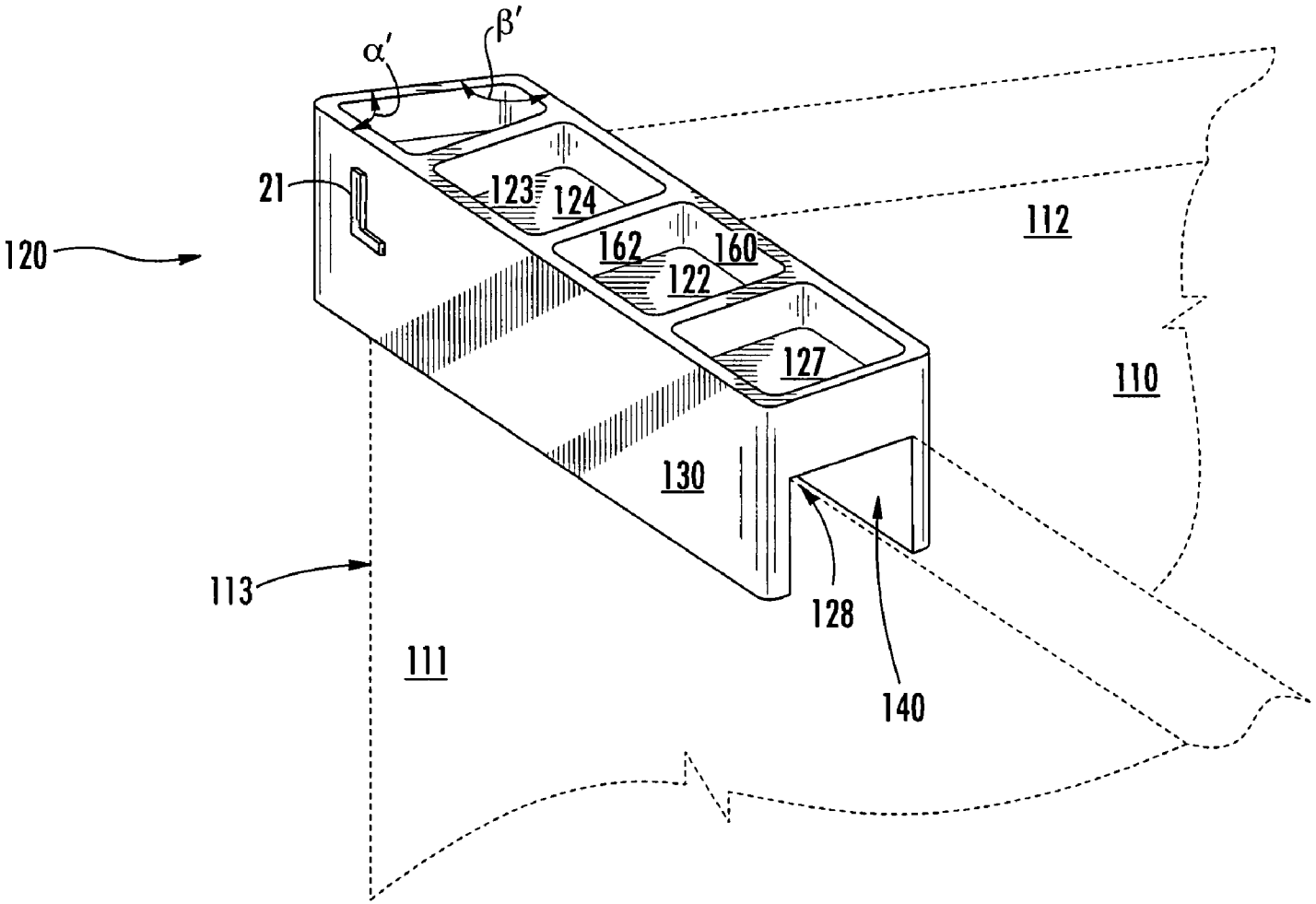
FIG. 4 is a perspective view of a protective device according to additional embodiments of the present invention installed on a cabinet.
Figure 5:
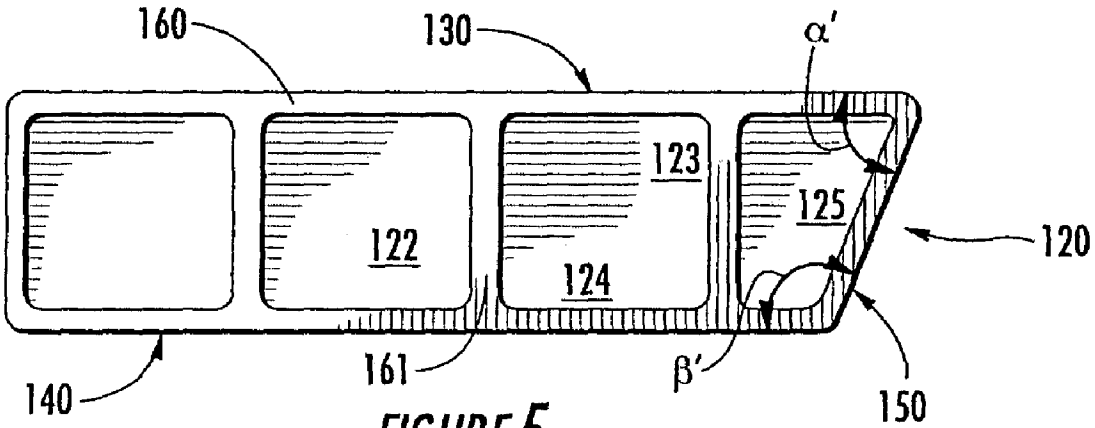
FIG. 5 is a top view of the protective device of FIG. 4 in an uninstalled state.
Figure 6:
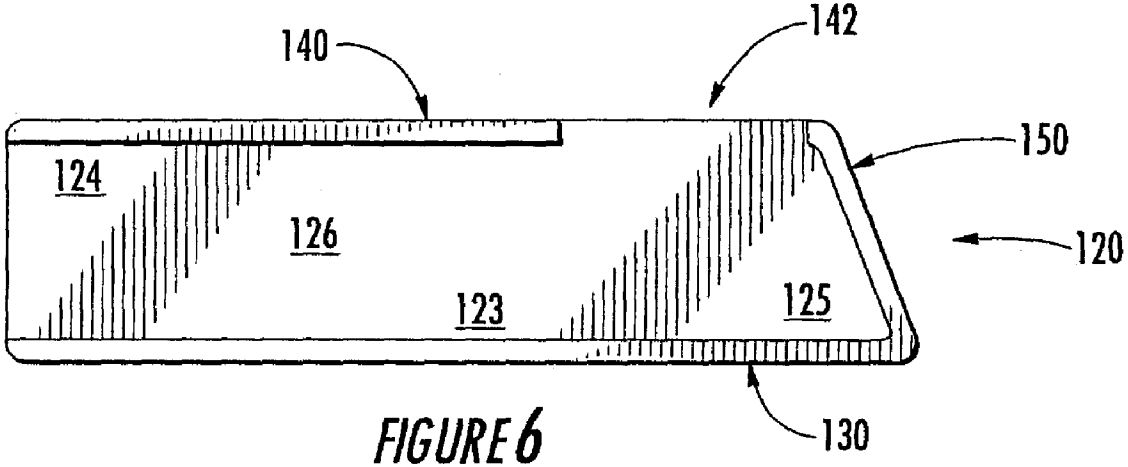
FIG. 6 is a bottom view of the protective device of FIG. 4 in an uninstalled state.

FIGS. 4-6 depict another embodiment of present invention in which a protective device 120 is provided. As will be appreciated by those of skill in the art, the protective device 120 is nearly identical to protective device 20 except that (a) the protective device 120 has a slightly different configuration of reinforcing ribs 162 and (b) the protective device 120 is configured to protect an object 110 that has a 67.5 degree corner. It will be appreciated based on the present disclosure that protective devices may be provided according to the teachings of the present invention that protect corners of any acute angle (or 90 degree angles) by modifying the angle $\alpha$ (in the protective device 20 of FIGS. 1-3) or the angle $\alpha'$ (in the protective device 120 of FIGS. 4-6) to correspond to the angle of the corner to be protected.

Corner protectors of the invention may be formed of polymeric, typically thermoplastic, material, such as polystyrene, polyethylene, polypropylene, nylon, high impact polystyrene and ABS. The protector can be manufactured by injection molding in accordance with conventional techniques, so that the resulting part is a single integral unit of thermoplastic material.

It will also be appreciated that the present invention is described and claimed herein from an orientation where the device is used to protect a top corner or edge of an object 10. Accordingly, when the same protective device 20 is used to protect a bottom edge or corner of an object the top member 22 will rest below the object 10 and the inner and outer walls 40, 30 will extend upwardly from the top member 22.

While the present invention has been described above with respect to the protective devices themselves and the cabinet or other object being protected shown in partial view only, it will be appreciated that the present invention also may be viewed as the combination of a cabinet or other object and a protective device as described above, with the protective device installed on the cabinet in the manner described above. A single protective device or multiple protective devices may be installed, along front and/or back, and along top and/or bottom corners, depending upon the features of the particular cabinet or other object being protected. Wood cabinets are particularly suitable for protection with the protective devices of the present invention.

The foregoing is illustrative of the present invention, and is not to be construed as limiting thereof. The invention is defined by the following claims, with equivalents of the claims to be included therein.

That which is claimed is:

1. A corner protector in combination with a cabinet that includes a first wall and a second wall, the corner protector comprising:

a top member having an inner portion, an outer portion and a side portion;

a generally planar inner wall connected to and extending downwardly from the inner portion of the top member, the inner wall including a cut-out portion;

a generally planar outer wall connected to and extending downwardly from the outer portion of the top member, the outer wall spaced apart from, and substantially parallel to, the inner wall;

a side wall connected to and extending downwardly from the side portion of the top member;

wherein the plane defined by the side wall and the plane defined by the outer wall intersect at an acute angle, and wherein the top member, the inner wall and the outer wall define a cavity, and wherein the first wall of the cabinet and the second wall of the cabinet are received within the cavity.

2. The corner protector in combination with the cabinet of claim 1, wherein the corner protector further comprises a raised lip that extends upwardly from the top member along at least a portion of the periphery of the top member.

3. The corner protector in combination with the cabinet of claim 2, wherein the corner protector further comprises at least one rib disposed on a top surface of the top member.

4. The corner protector in combination with the cabinet of claim 1, and wherein the cutout portion of the inner wall is an end portion of the inner wall.

5. A corner protector in combination with an object that has a first wall and second wall, the corner protector comprising:

an outer wall;

an inner wall located opposite the outer wall and extending substantially parallel to the outer wall;

a side wall connected to the outer wall;

a top member connected to at least two of the outer wall, the inner wall and the side wall, wherein the inner wall is a substantially planar wall and wherein the outer wall is a substantially planar wall, wherein a portion of the inner wall adjacent the side wall includes a cutout portion that forms a first opening into a cavity defined by the inner wall, the outer wall and the side wall, wherein a second opening is provided into the cavity between the inner wall and the outer wall opposite the side wall, and wherein the first opening receives the first wall of the object and the second opening receives the second wall of the object, and wherein the side wall and the outer wall connect to form an acute angle and wherein a plane defined by the side wall and a plane defined by the inner wall intersect at an obtuse angle.

6. The corner protector in combination with the object according to claim 5, wherein the top member is substantially perpendicular to the outer wall, the inner wall and the side wall.

7. The corner protector in combination with the object according to claim 6, wherein the outer wall, the inner wall, and the side wall extend above a top surface of the top member to form a ridge around the periphery of the top member.

8. The corner protector in combination with the object according to claim 7, wherein a plurality of support ribs are provided on the top surface of the top member that connect the outer wall to the inner wall.

9. The corner protector in combination with the object according to claim 8, wherein at least one support rib is provided on the top surface of the top member that connects the outer wall to the side wall.

10. The corner protector in combination with the object according to claim 5, wherein the acute angle is approximately 67 degrees.

11. The corner protector in combination with the object according to claim 5, wherein the acute angle is approximately 45 degrees.

12. The corner protector in combination with the object according to claim 5, wherein the inner wall and outer wall are resilient.

13. The corner protector in combination with the object according to claim 12, wherein a portion of the cavity between the inner wall and the outer wall has a width that is slightly less than the width of the second wall of the object, such that the inner wall and the outer wall form an interference fit with the second wall of the object when the second wall of the object is received within the cavity.

14. The corner protector in combination with the object according to claim 5, wherein the object comprises a cabinet.

15. A corner protector in combination with an object having a first wall and a second wall, the corner protector comprising:

a top member having an inner portion, an outer portion and a side portion;

a generally planar inner wall connected to and extending downwardly from the inner portion of the top member;

a generally planar outer wall connected to and extending downwardly from the outer portion of the top member, the outer wall spaced apart from, and substantially parallel to, the inner wall; and a side wall connected to and extending downwardly from the side portion of the top member;

wherein the plane defined by the side wall and the plane defined by the outer wall intersect at an acute angle, wherein a portion of the inner wall adjacent the side wall includes a cutout portion that forms a first opening into a cavity that resides below a lower surface of the top member, the cavity defined by the inner wall, the outer wall and the side wall, wherein a second opening is provided into the cavity between the inner wall and the outer wall opposite the side wall, and wherein the first and second walls of the object are received within the cavity so that a portion of a corner defined by the first and second walls of the object is protected by the corner protector.

16. The corner protector in combination with the object of claim 15, wherein the acute angle is approximately 67 degrees.

17. The corner protector in combination with the object of claim 15, wherein the acute angle is approximately 45 degrees.

18. The corner protector in combination with the object of claim 15, wherein the corner protector includes indicia indicating the side of the object on which the protective device is to be used.

19. The corner protector in combination with the object of claim 15, wherein the length of the inner wall is different than the length of the outer wall.

20. The corner protector in combination with the object of claim 15, wherein the corner protector is integrally formed of polymeric material.

21. The corner protector in combination with the object of claim 20, wherein the corner protector is formed from injection molded thermoplastic material.

22. The corner protector in combination with the object of claim 15, wherein a side edge of the side wall directly contacts a side edge of the outer wall.

23. The corner protector in combination with the object of claim 15, wherein the cavity includes a channel portion between the inner wall and the outer wall that has a width that is slightly less than the width of the second wall of the object such that the inner wall and the outer wall form an interference fit with the second wall of the object.

* * * * *